US006170937B1

(12) United States Patent
Childers et al.

(10) Patent No.: US 6,170,937 B1
(45) **Date of Patent: *Jan. 9, 2001**

(54) INK CONTAINER REFURBISHMENT METHOD

(75) Inventors: Winthrop D Childers; Michael L Bullock, both of San Diego, CA (US); Peter A Dewing, Portland, OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/034,719

(22) Filed: Mar. 4, 1998

Related U.S. Application Data

(63) Continuation-in-part of application No. 08/785,580, filed on Jan. 21, 1997, now Pat. No. 5,812,156.

(51) Int. Cl.[7] ..... B41J 2/175
(52) U.S. Cl. ..... 347/85
(58) Field of Search ..... 347/85, 86, 87, 347/7

(56) References Cited

U.S. PATENT DOCUMENTS

| | | | | |
|---|---|---|---|---|
| 5,068,806 | | 11/1991 | Gattan | 395/113 |
| 5,414,452 | | 5/1995 | Accatino et al. | 347/7 |
| 5,506,611 | | 4/1996 | Ujita et al. | 347/86 |
| 5,607,003 | * | 3/1997 | Gray | 141/285 |
| 5,694,156 | | 12/1997 | Hoisington et al. | 347/7 |
| 5,699,091 | | 12/1997 | Bullock et al. | 347/19 |
| 5,721,576 | | 2/1998 | Barinaga | 347/85 |
| 5,732,751 | | 3/1998 | Scmidt et al. | 141/48 |
| 5,812,156 | * | 9/1998 | Bullock et al. | 347/19 |
| 5,845,682 | | 12/1998 | Hayao | 141/18 |

FOREIGN PATENT DOCUMENTS

| | | | |
|---|---|---|---|
| 0720916 | 10/1996 | (EP) | B41J/2/175 |
| 0 741 038 A2 | 11/1996 | (EP) | B41J/2/175 |
| 0 808 718 A2 | 11/1997 | (EP) | B41J/2/175 |
| 2 321 623 | 8/1998 | (GB) | B41J/2/175 |
| WO 85/00454 | 1/1985 | (WO) | G07C/3/00 |
| WO 94/11194 | 5/1994 | (WO) | B41J/2/175 |

* cited by examiner

*Primary Examiner*—N. Le
*Assistant Examiner*—Michael Nghiem
(74) *Attorney, Agent, or Firm*—Kevin B. Sullivan; Winthrop D. Childers

(57) ABSTRACT

Alternative methods for refurbishing a single-use ink delivery container for a printing system are described. The refurbishing methods include electrical and mechanical reconfiguration or replacement of original elements on the ink delivery container. Each method utilizes an existing ink fluid outlet, electrical connector and an information storage device on the ink delivery container.

17 Claims, 10 Drawing Sheets

INK CONTAINER REFURBISHMENT METHOD

CROSS-REFERENCES TO RELATED APPLICATIONS

This application is a continuation-in-part of U.S. patent application Ser. No. 08/785,580, filed Jan. 21, 1997, "Apparatus Controlled By Data From Consumable Parts With Incorporated Memory Devices", now U.S. Pat. No. 5,812,156 issued Sep. 22, 1998. Also, this application is related to commonly invented and assigned co-pending patent application attorney docket number 10971933-1, filed herewith, entitled "Ink Delivery System Adapter", U.S. patent application No. 09/034,874 filed Mar. 4, 1998 incorporated herein by reference, and is related to commonly assigned co-pending patent application attorney docket number 10971934-1, filed herewith, entitled "Electrical Refurbishment for Ink Delivery System", U.S. patent application Ser. No. 09/034,875 filed Mar. 4, 1998 incorporated herein by reference.

TECHNICAL FIELD

This invention relates in general to refurbishing printing system ink containers and in particular to refurbishing ink containers for ink-jet printing systems.

BACKGROUND ART

One type of ink-jet printing system has a printhead mounted to a carriage that is moved back and forth over print media, such as paper. As the printhead passes over appropriate locations on the print media, a control system activates the printhead to eject ink drops onto the print media and form desired images and characters. To work properly, such printing systems must have a reliable supply of ink for the printhead.

One category of ink-jet printing system uses an ink supply that is mounted to and moves with the carriage. In some types, the ink supply is replaceable separately from the printhead. In others, the printhead and ink supply together form an integral unit that is replaced once the ink in the ink supply is depleted.

Another category of printing system uses ink supplies that are not located on the carriage. One type replenishes the printhead intermittently. The printhead will travel to a stationary reservoir periodically for replenishment. Another type, referred to as a replaceable off-axis ink supply, has a replaceable ink cartridge or container connected to the printhead by a fluid conduit. The ink cartridge has a fluid reservoir filled with ink and located within a housing. The reservoir has a fluid coupling mechanism for coupling the reservoir to the printing system so that ink may flow from the reservoir to the printhead. The reservoir is sometimes pressurized in some manner to provide a reliable high flow rate supply of ink to the printhead.

In the parent application to this U.S. patent application, Ser. No. 08/785,580, U.S. Pat. No. 5,812,156 a replaceable off-axis cartridge is described which has a memory device mounted to the housing. When inserted into the printing system station, an electrical connection between the printing system and the memory device is established. This electrical connection allows for the exchange of information between the printing system and the memory. The memory device stores information that is utilized by the printing system to ensure high print quality. This information is provided to the printing system automatically when the cartridge is mounted to the printing system. The exchange of information assures compatibility of the cartridge with the printing system. The stored information includes helpful information, such as the date when the cartridge was first installed on a printing system. This installation date indicates whether the ink is out of date and thus losing quality.

Another use for the memory device discussed in Ser. No. 08/785,580 U.S. Pat. No. 5,812,156 is to prevent the use of the cartridge after the supply of ink is depleted. Operating a printing system when the reservoir has been depleted of ink can destroy the printhead. The memory devices concerned with this application are updated with data from the printing system concerning the amount of ink left in the reservoir as it is being used. When a new cartridge is installed, the printing system will read information from the memory device indicative of the reservoir volume. During usage, the printing system estimates ink usage and updates the memory device to indicate how much ink is left in the cartridge. When the ink is substantially depleted, this type of memory device can store data indicative of an out of ink condition. When substantially depleted of ink, these cartridges are typically discarded and a new cartridge along with a new memory device is installed.

After being depleted of ink, the cartridges are potentially capable of further use if replenished with a fresh supply of ink. However, these cartridges are designed for single use because of the information stored in the memory device that indicates the amount of ink that was in the reservoir prior to being refilled. If refilled and installed again on a printing system, the data in the memory would still indicate the volume of ink that it contained prior to refilling. The data would still indicate the initial installation date, not the date when it was re-installed on a printing system. The low ink warning which the memory would signal would not be meaningful to the user because it would be inaccurate. The user would be deprived of the numerous advantages and safeguards of the memory device. As a result, the reservoir is not designed for refilling.

DISCLOSURE OF THE INVENTION

The present invention comprises alternative methods for refurbishing an original equipment, single-use ink delivery container for a printing system. The printing system has an ink fluid inlet and an electrical connector. The ink container refurbishing methods include electrical, fluidic, and/or mechanical reconfiguration or replacement of original elements on the ink delivery container. Each method utilizes an existing ink fluid outlet location and electrical connector location on the ink container. Each ink container also has an information storage device that may be modified or replaced depending on the refurbishment method selected.

BEST MODE FOR CARRYING OUT THE INVENTION

Although the present invention comprises a means of electrically and fluidically refurbishing an ink container, the invention may be more clearly understood with a thorough discussion of the printing system and original equipment ink container.

Figure 1:
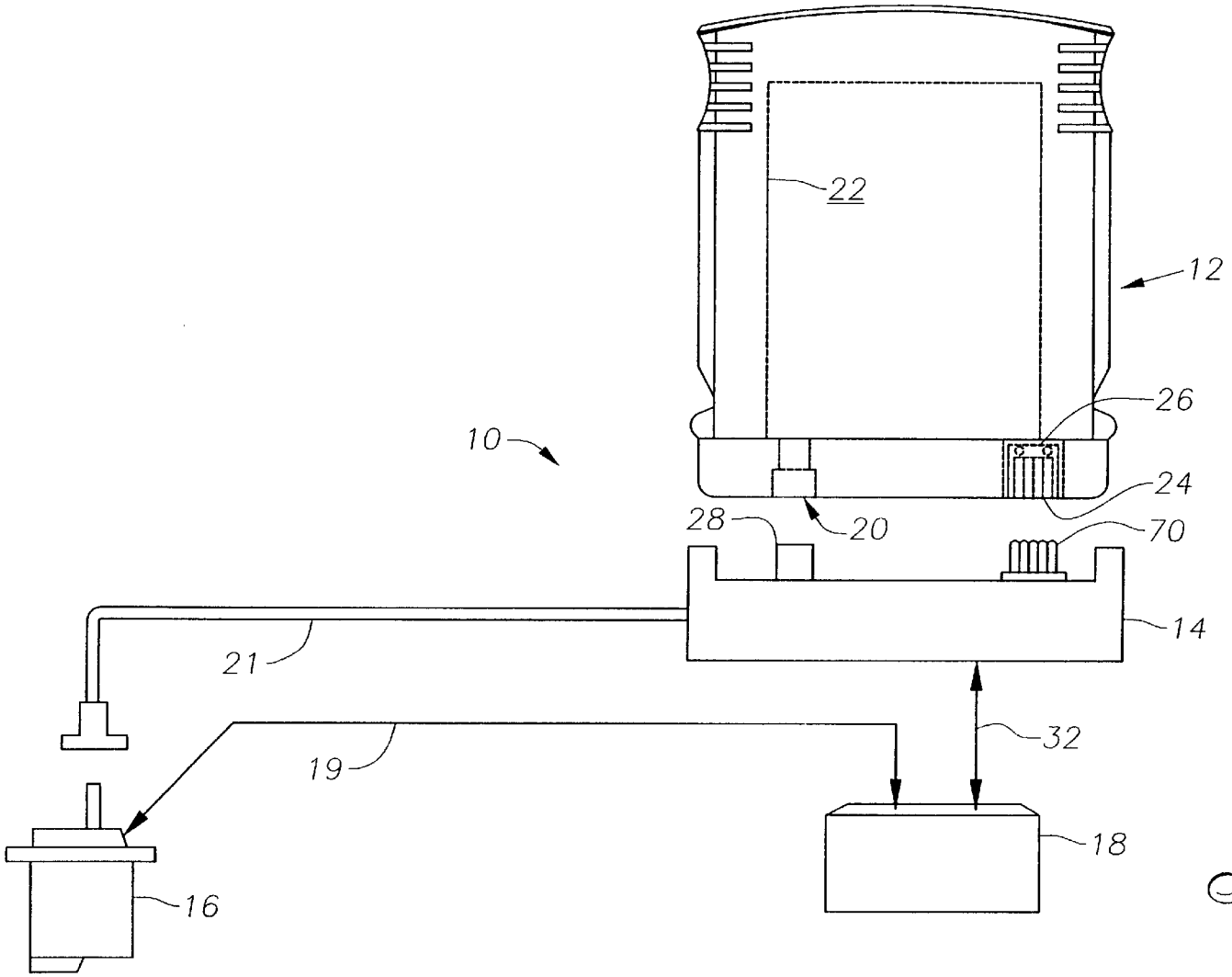
FIG. 1 is a schematic diagram of an ink-jet printing system and original equipment ink container.

FIG. 1 illustrates a portion of an ink-jet printing system 10 having an original equipment ink cartridge or container 12. The ink-jet printing system 10 includes an ink container receiving station 14, an ink-jet printhead 16, and a print controller 18. Printing is accomplished by the ejection of ink from the printhead 16 under the control of print controller 18. Printhead 16 is connected to the controller 18 by link 19 for controlling ejection of ink. Ink is provided to the printhead 16 by way of a fluid conduit 21, which joins the printhead 16 to the receiving station 14. Ink container 12 includes a fluid outlet 20 that communicates with a fluid reservoir 22. Ink container 12 also includes electrical terminals or contacts 24 that communicate with an information storage device 26 such as a memory device.

Fluid outlet 20 and electrical contacts 24 allow ink container 12 to interconnect with a fluid inlet 28 and electrical contacts 30, respectively, on receiving station 14. Receiving station 14 enables ink to be transferred from fluid reservoir 22 to printhead 16 via fluid conduit 21. In addition, receiving station 14 allows the transfer of information between information storage device 26 and print controller 18 via a link 32.

Each ink container 12 has unique ink container-related aspects that are represented in the form of data stored on information storage device 26. This data is provided from ink container 12 to printing system 10 via information storage device 26 automatically without requiring the user to reconfigure printing system 10 for the particular ink container 12 installed. The data provided may be indicative of the ink container manufacturer identity, type of ink and date code of the ink container 12. In addition, the data provided may include system parameters, such as system coefficients and service mode.

Printing system 10 monitors the level of deliverable ink in ink container 12 via information storage device 26. Information storage device 26 stores volume information indicative of the level of deliverable ink in ink container 12. Printing system 10 updates this volume information by altering memory device 26 and queries this volume information by receiving data from memory device 26. In a preferred embodiment, communication including transfer of data between printing system 10 and information storage device 26 is accomplished in serial fashion along a single data line 32 relative to ground.

In a preferred embodiment, the volume information includes the following: (1) initial supply size data in a write protected portion of memory, (2) coarse ink level data stored in write once portion of memory and (3) fine ink level data stored in a write/erase portion of memory. The initial supply size data is indicative of the amount of deliverable ink initially present in ink container 12.

The coarse ink level data includes a number of write once bits that each correspond to some fraction of the deliverable ink initially present in ink container 12. In a first preferred embodiment, eight coarse ink level bits each correspond to one-eighth of the deliverable ink initially in ink container 12. In a second preferred embodiment, to be used in the discussion that follows, seven coarse ink level bits each correspond to one-eighth of the deliverable ink initially present in ink container 12 and one coarse ink level bit corresponds to an out-of-ink condition. However, more or less coarse bits can be used, depending on the accuracy desired for a coarse ink level counter.

The fine ink level data is indicative of a fine bit binary number that is proportional to a fraction of one-eighth of the volume of the deliverable ink initially present in ink container 12. Thus, the entire range of the fine bit binary number is equivalent to one coarse ink level bit. This will be further explained below.

Printing system 10 reads the initial supply size data and calculates the amount or volume of deliverable ink initially present in ink container 12. An estimated drop volume ejected by the printhead 16 is determined by printing system 10 by reading parameters and/or performing calculations. Using the initial volume of deliverable ink in ink container 12 and the estimated drop volume of printhead 16, the printing system 10 calculates the fraction of the initial deliverable ink volume that each drop represents. This enables the printing system 10 to monitor the fraction of the initial volume of deliverable ink remaining in ink container 12.

While printing, printing system 10 maintains a drop count equal to the number of ink drops that have been ejected by printhead 16. After printing system 10 has printed a small amount, typically one page, it converts the drop count to a number of increments or decrements of the fine bit binary number. This conversion utilizes the fact that the entire range of the fine bit binary number corresponds to one eighth of the initial volume of deliverable ink in ink container 12. Each time the fine bit binary number is fully decremented or incremented, the printing system 10 writes to one of the coarse ink level bits to "latch down" the bit.

Printing system 10 periodically queries the coarse and fine ink level bits to determine the fraction of the initial deliverable ink that is remaining in ink container 12. Printing system 10 can then provide a "gas gauge" or other indication to a user of printing system 10 that is indicative of the ink level in ink container 12. In a preferred embodiment, the printing system provides a "low ink warning" when the sixth (second to last) coarse ink level bit is set. Also in a preferred embodiment, the printing system sets the eight (last) coarse ink level bit when the ink container 12 is substantially depleted of ink. This last coarse ink level bit is referred to as an "ink out" bit. Upon querying the coarse ink level bits, the printing system interprets a "latched down" ink out bit as an "ink out" condition for ink container 12.

Figure 2:
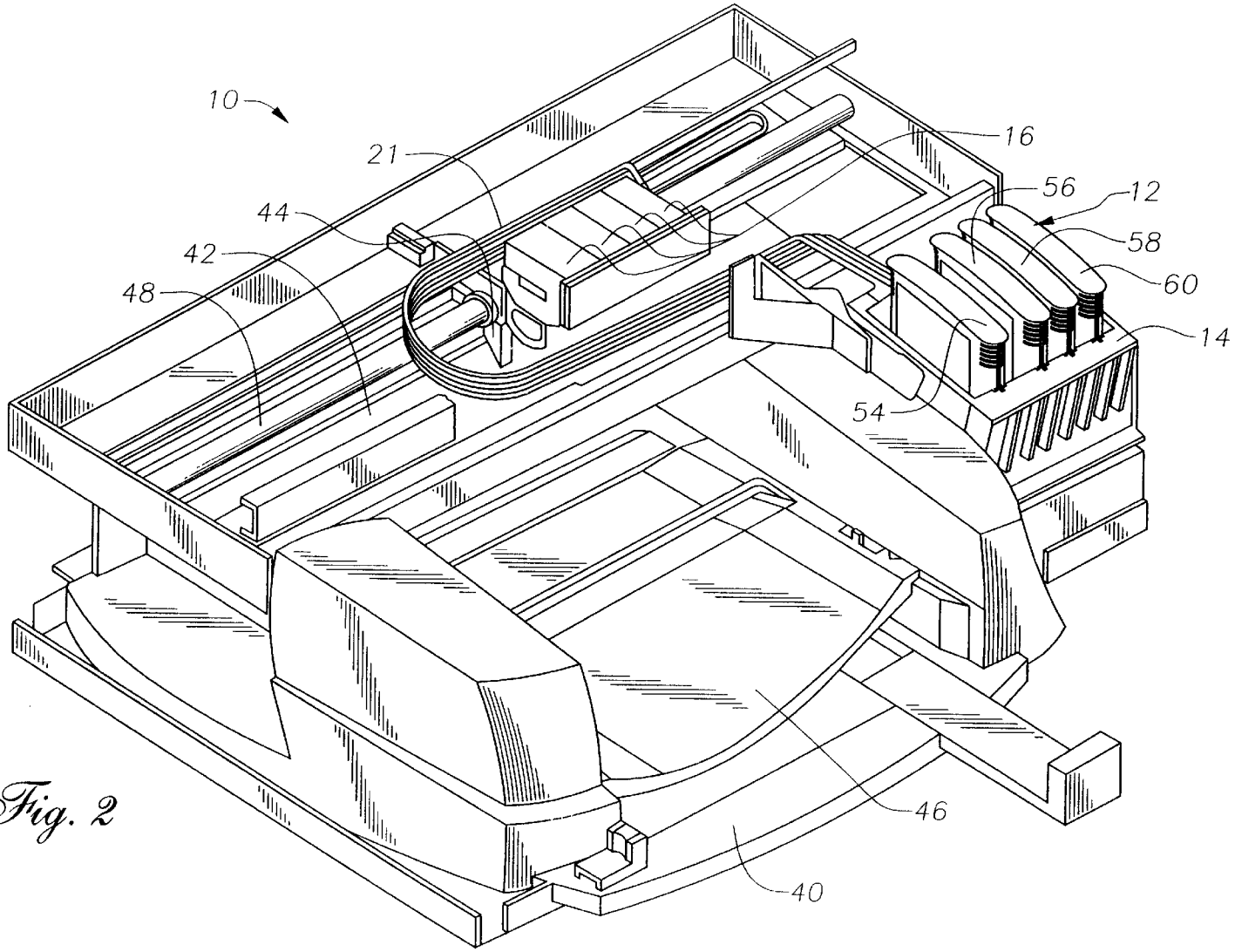
FIG. 2 is an isometric view of the ink-jet printing system of FIG. 1.

Referring now to FIG. 2, a preferred embodiment of printing system 10, with its cover removed, is capable of holding four ink containers 12 at the same time. Printing system 10 includes a tray 40 for holding a paper supply.

When a printing operation is to be initiated, a sheet of paper from tray 40 is fed into printing system 10 using a sheet feeder (not shown). During printing, the paper passes through a print zone 42 whereupon a scanning carriage 44 containing one or more printheads 16 is scanned across the sheet for printing a swath of ink thereon. The sheet of paper is stepped through the print zone 42 as the scanning carriage 44 prints a series of swaths of ink to form images thereon. After printing is complete, the sheet is positioned into an output tray 46. The positioning of paper supply 40 and output tray 46 can vary depending on the particular sheet feed mechanism used. Scanning carriage 44 slides through the print zone 42 on a scanning mechanism which includes a slide rod 48. A positioning means such as a coded strip (not shown) is used in conjunction with a photo detector for precisely positioning scanning carriage 44. A stepper motor (not shown), connected to scanning carriage 44 using a conventional drive belt and pulley arrangement, is used for transporting scanning carriage 44 across print zone 42. A ribbon cable (not shown) carries electrical signals to the scanning carriage 44 for selectively energizing the printheads 16 (FIGS. 1 and 2). As the printheads 16 are selectively energized, ink of a selected color is ejected onto the print media as scanning carriage 44 passes through print zone 42.

Figure 3:
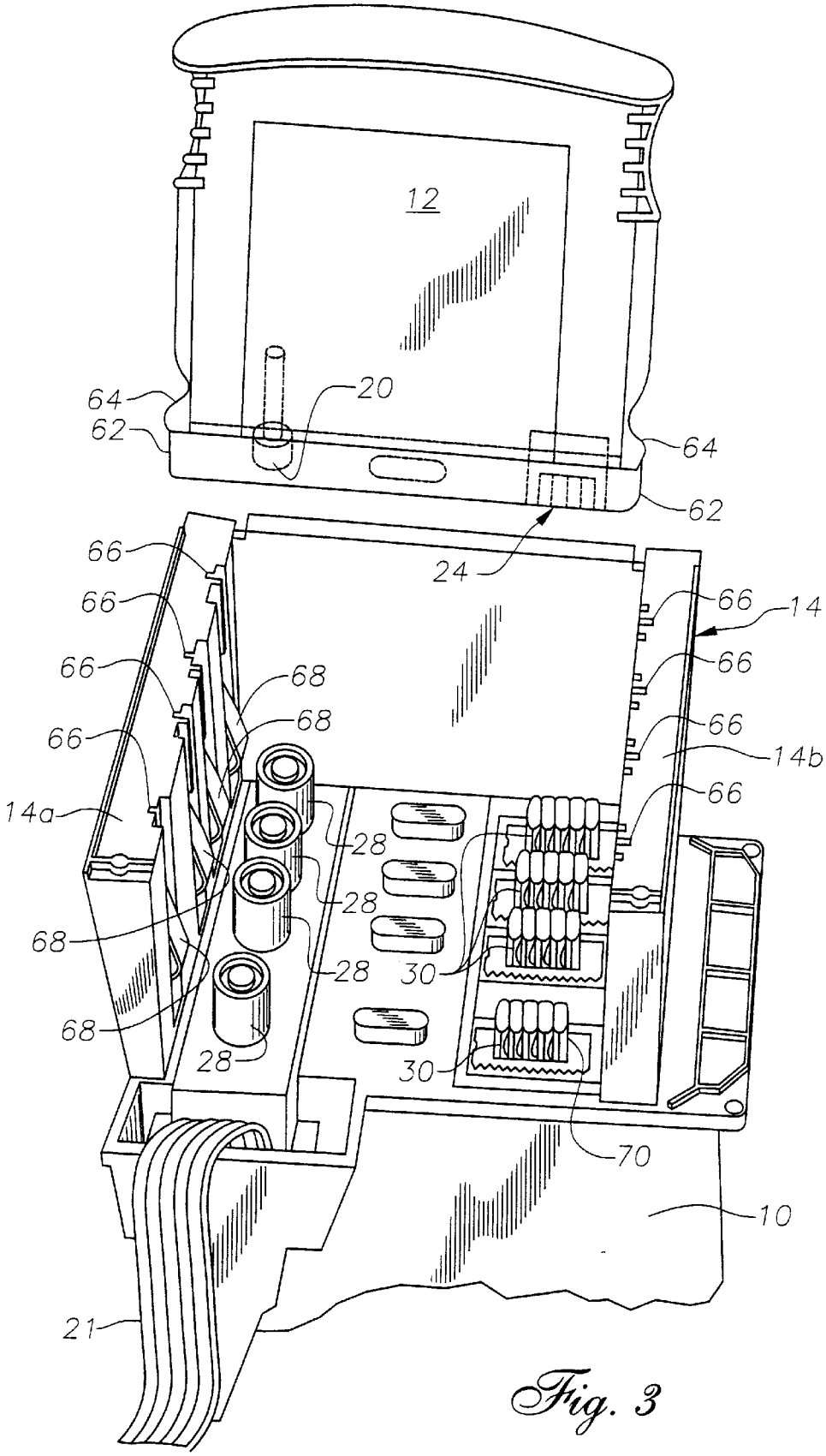
FIG. 3 is an isometric view of an ink supply station on the ink-jet printing system of FIG. 1.
Figure 4:
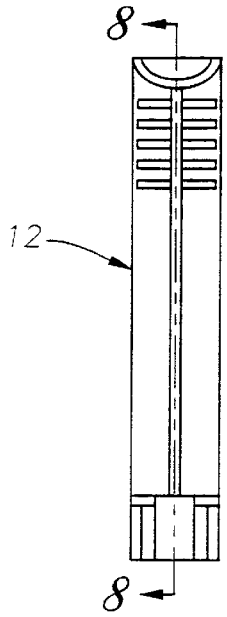
FIG. 4 is a side view of the ink container of FIG. 1.

Each ink container 12 has its own electrical contacts 24 and fluid outlet 20 (FIG. 3). Ink containers 12 may be referred to as an off-axis ink supply since the ink supply is spaced from a scan axis defined by scanning carriage 44. In the case of color printing, ink containers 12 are typically separate ink containers for each color with a container for black ink. For example, ink container 12 for the embodiment shown in FIG. 2 is an ink container 54 for black ink, an ink container 56 for yellow ink, an ink container 58 for magenta ink, and an ink container 60 for cyan ink. Receiving station 14 contains mechanical, fluid and electrical interfaces for each ink container 12. Ink passes through the fluid interfaces in receiving station 14, fluid conduits 21 and then to printheads 16 on print scanning carriage 44.

Referring to FIG. 3, receiving station 14 has a first end 14*a* and a second end 14*b* with inward facing first and second walls, respectively. A plurality of the fluid inlets 28 are located near first end 14*a* for providing ink to a plurality of corresponding printheads 16 via conduits 21 (FIG. 1). A plurality of the electrical contacts 30 are located near the second end 14*b* for providing electrical signals to controller 18 (FIG. 1). Each fluid inlet 28 is located as far from electrical contacts 30 as possible to prevent contamination of contacts 30 with ink from fluid inlets 28.

Figure 7:
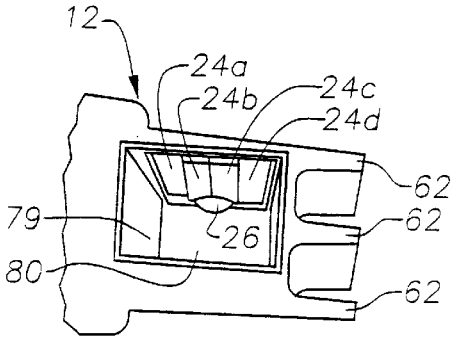
FIG. 7 is an enlarged bottom view of the ink container of FIG. 1 showing detail of the electrical interconnect portion of the ink container.

As shown also in FIG. 7, ink container 12 has aligning ribs 62 on each side edge. Aligning ribs 62 mate with slots 66 (FIG. 3) on receiving station 14 to assist in aligning ink container 12 for insertion into receiving station 14. Aligning ribs 62 and slots 66 also provide a keying function to ensure that ink container 12 contains ink having the proper parameters, such as color and ink compatibility with printing system 10. Ink container also has latch shoulders 64 on each side edge, as shown in FIG. 3, which are engaged by resilient latches 68 mounted on the sidewalls of receiving station 14. Once ink container 12 is aligned and inserted into receiving station 14, latches 68 on receiving station 14 engage corresponding latch shoulders 64 on ink container 12. Insertion of ink container 12 into receiving station 14 forms both electrical and fluid interconnects between contacts 24 and 30, and ports 20 and 28, respectively.

Figure 10:
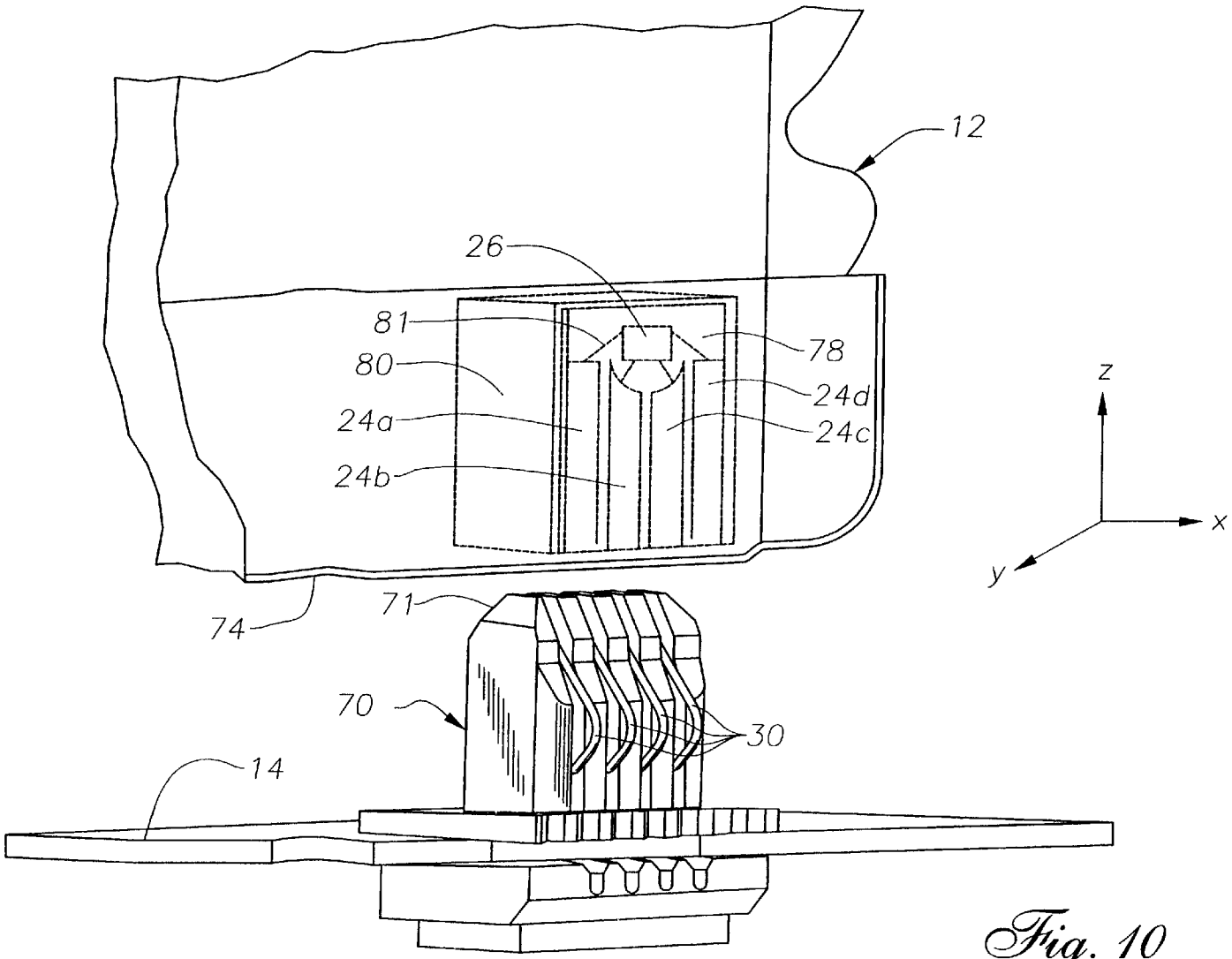
FIG. 10 is an isometric view of a lower portion of the ink container of FIG. 1, shown prior to engaging the electrical connector of the ink-jet printing system of FIG. 1.

Referring to FIG. 3, receiving station 14 has four separate electrical connector posts 70, one for each of the cartridges 12. The four electrical contacts 30 for each cartridge 12 are mounted to each electrical connector post 70, as shown in FIG. 10. Electrical connector posts 70 are substantially free to float in a plane that is substantially perpendicular with respect to a direction of insertion of ink container 12 into receiving station 14. The direction of insertion of ink container 12 is indicated as the z-axis, and the plane in which connector post 70 floats is indicated by the x and y-axes, or the xy plane. Contacts 30 extend laterally from one side of post 70 along a direction parallel to the x-axis, and are arrayed along the y-axis. Connector post 70 includes a tapered leading portion 71 that tapers in an upward direction, or along the z-axis. Contacts 30 are outwardly spring biased from connector post 70.

Figure 5:
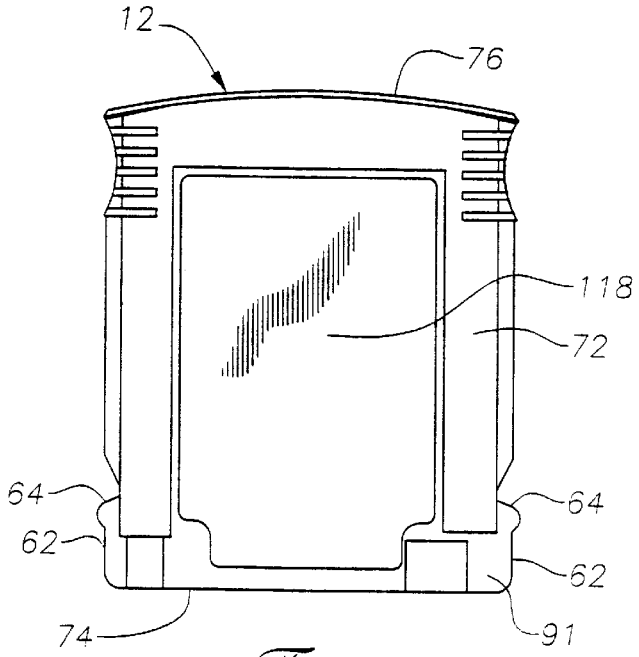
FIG. 5 is a front view of the ink container of FIG. 1.
Figure 6:
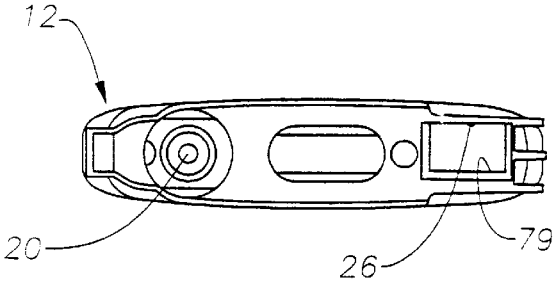
FIG. 6 is a bottom view of the ink container of FIG. 1.

Referring to FIG. 5, ink container 12 includes an outer surface or housing 72 having a leading edge or end 74 and a trailing edge or end 76 relative to the direction of insertion of ink container 12 into receiving station 14 (FIG. 3). As shown in FIG. 7, there are four terminals or contacts 24 on the ink container, 24*a* for ground, 24*b* for clocking signals, 24*c* for power, and 24*d* for input and output data. Contacts 24 are located in a small cavity 80 on a lower side of housing 72 adjacent to leading edge 74. Cavity 80 has four perpendicular sidewalls 79.

Referring to FIG. 10, contacts 24 are metal conductive layers disposed on a substrate 78 of electrical insulation material such as epoxy and fiberglass. Four traces or leads 81 are disposed on substrate 78, each extending from one of the contacts 24. Memory device 26 is mounted to substrate 78, and the terminals of memory device 26 are joined to the traces 81. This places memory device 26 in electrical continuity with contacts 24. Adhesive (not shown) is used to encapsulate memory device 26 after its terminals are bonded to traces 81. Substrate 78, along with contacts 24 and memory device 26, is bonded by adhesive or swaged to a sidewall of cavity 80. Electrical contacts 24 are positioned along the z-axis when ink container 12 is oriented for engagement with receiving station 14.

The entrance to cavity 80 is sized to be small enough to reduce the possibility of fingers from entering cavity 80. The proper sizing of the entrance is important for preventing contamination of contacts 24 during handling of ink container 12. Cavity 80 closely receives one of the connector posts 70. As ink container 12 is inserted into printing system 10, resilient contacts 30 are compressed against contacts 24 to form a low resistance electrical connection between printing system 10 and memory device 26.

When ink container 12 is releasably installed into receiving station 14, tapered portion 71 engages cavity 80 to provide alignment between connector post 70 and cavity 80 such that connector post 70 can partially pass into it. In other words, tapered portion 71 engages the contact surface of a first side and the opposing surface on a second side, aligning connector post 70 by providing an aligning force in the x-direction. The perpendicular side walls 79 engage tapered portion 71 to provide alignment in the y-direction. Being movably mounted in x and y directions, connector post 70 moves in these directions to provide proper alignment between contacts 24 and 30.

When ink container 12 is fully inserted into receiving station 14, spring-loaded contacts 30 provide a contact force along the x-direction which is opposed by an opposing force exerted by connector post 70. Because connector post 70 can float in the x and y-directions, the contact force and opposing force are substantially equal and opposite, such that they provide a substantially minimal or zero net force on connector post 70 and on ink container 12. Minimizing such a lateral force is important, since a lateral x or y force exerted on ink container 12 will tend to interfere with a proper fluidic connection between fluid outlet 20 on the one hand and fluid inlet 28 on the other.

Figure 8:
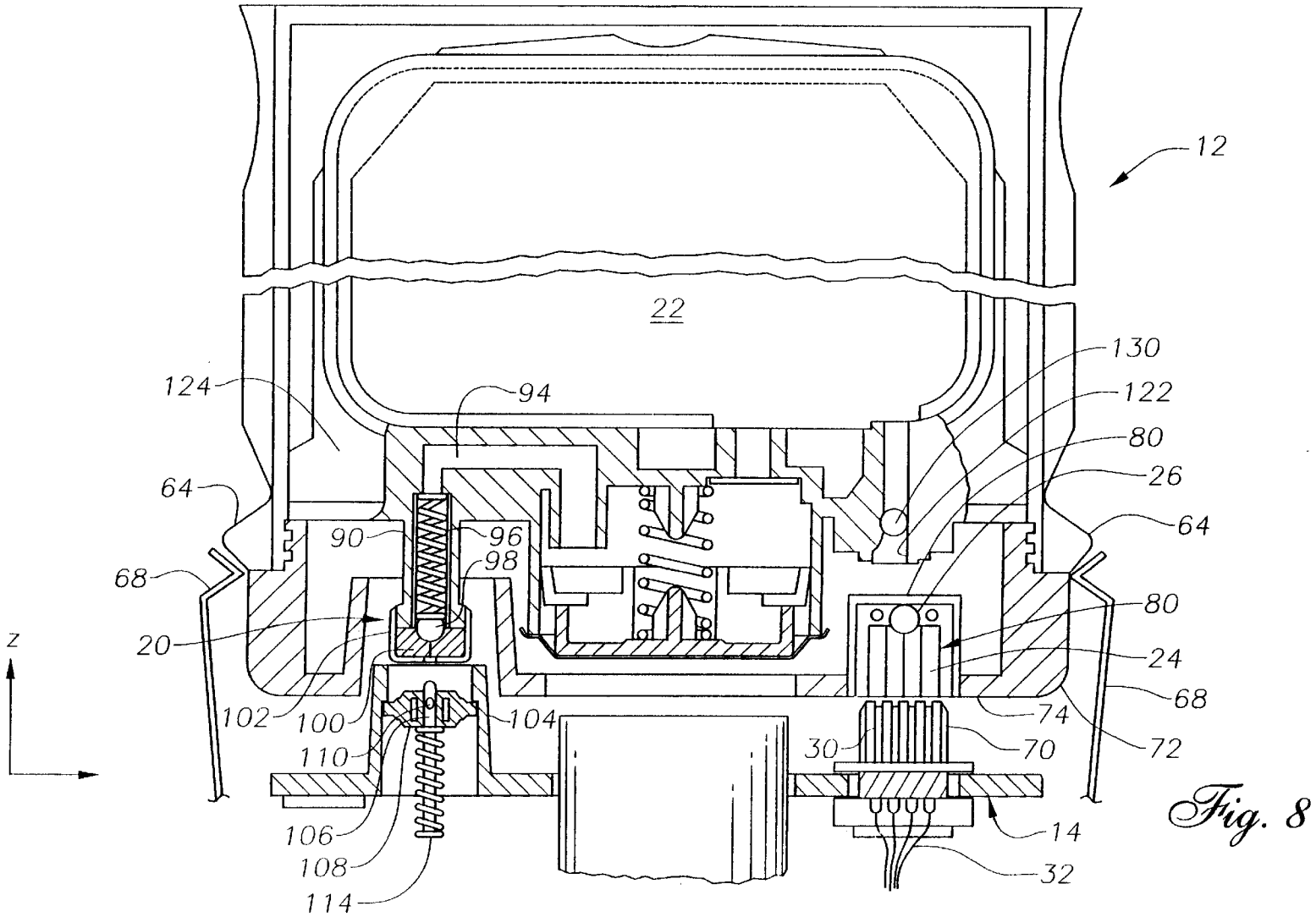
FIG. 8 is a sectional side view of the ink container of FIG. 1, shown just prior to engaging the ink-jet printing system of FIG. 1.

Referring to FIG. 8, fluid outlet 20 includes a hollow cylindrical tube or boss 90 that extends downward from ink container chassis 124. Boss 90 has an upper end that is fluidically connected to reservoir 22 and a lower or distal end that supports a septum 100. Conduit 94 is joined between boss 90 and ink reservoir 22. A spring 96 and sealing ball 98 are located within boss 90 and held in place by a compliant septum 100 and a crimp cover 102. Septum 100 is a resilient seal and has a slit that extends through it. Spring 96 biases sealing ball 98 against septum 100 to form a seal.

Figure 9:
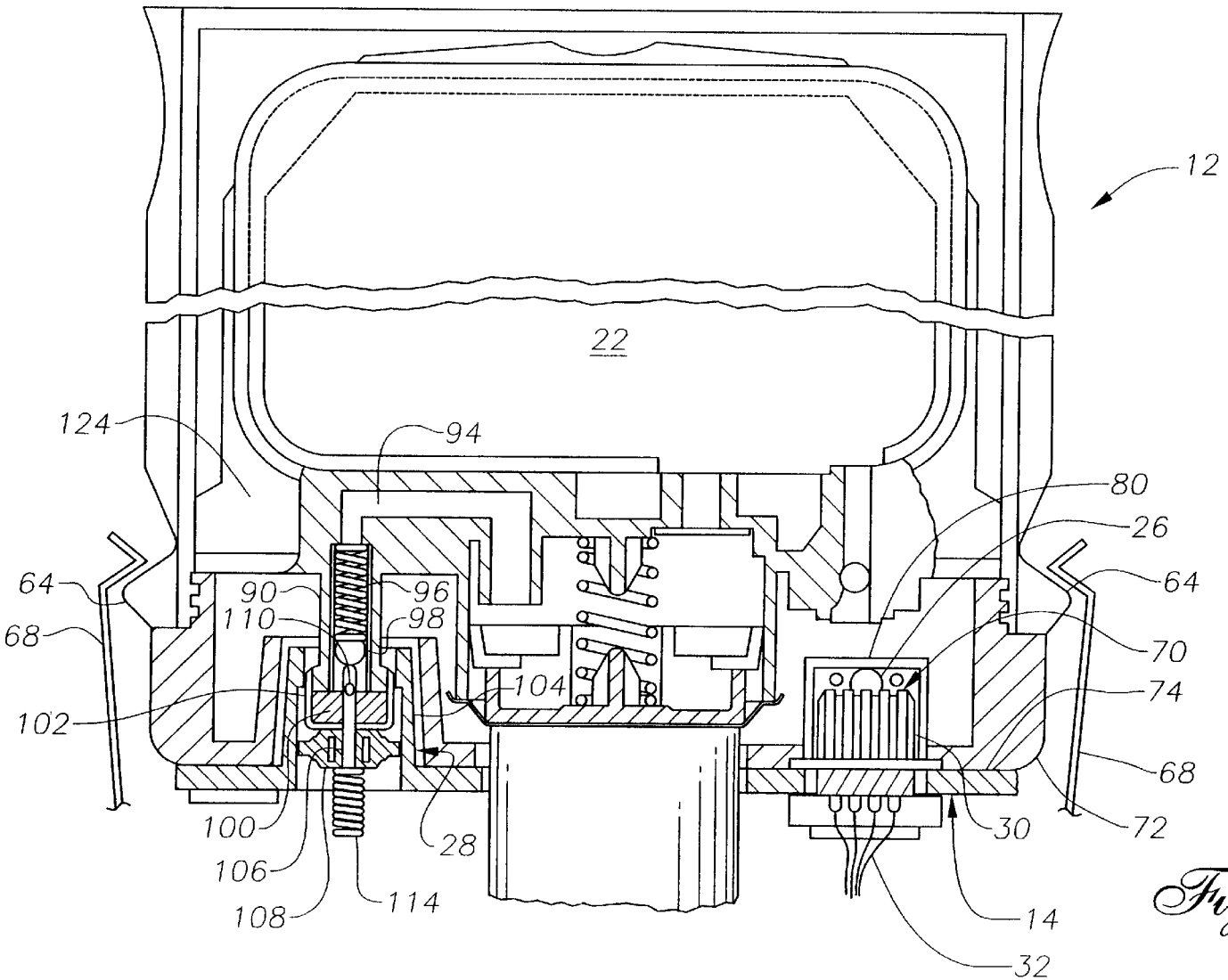
FIG. 9 is a sectional side view of the ink container of FIG. 1, shown fully engaged with the ink-jet printing system of FIG. 1.

Fluid inlet 28 on receiving station 14 includes a cylindrical housing 104 surrounding a needle 106. Needle 106 has a blunt upper end, a bore (not shown) and a lateral hole 110 that leads from the bore. The lower end of needle 106 is connected to conduit 21 (FIGS. 1–2) for providing ink to printhead 16. A sliding collar 108 surrounds needle 106 and is upwardly biased by a spring 114. Collar 108 has a compliant sealing portion with an exposed upper surface and an inner surface in direct contact with the needle 106. While in the upper position of FIG. 3, collar 108 seals hole 110 in needle 106. When pushed down to the lower position of FIG. 9, hole 110 of needle 106 inserted through the slit in septum 100 to establish fluid communication between conduit 21 and ink reservoir 22.

Boss 90 is dimensionally sized to be closely received within cylindrical housing 104. The tolerance between the outer diameter of boss 90 and inner diameter of housing 104 assures that the septum 100 can properly engage needle 106. The length of boss 90 must be sufficient for crimp cover 102 to push sliding collar 108 to a lower position to allow ink to flow into port 110 of needle 106.

When ink container 12 is installed into receiving station 14, the crimp cover 102 of boss 90 slides within housing 104 to align septum 100 with respect to needle 106. Needle 106 is then received by septum 100 and pushes ball 98 to a disengaged position. As needle 106 inserts into septum 100, crimp cover 102 depresses collar 108 so that hole 110 is exposed to receive fluid as described above. In the installed position, springs 68 engage latching portion 64 to firmly hold ink container 12 in place.

Figure 11:
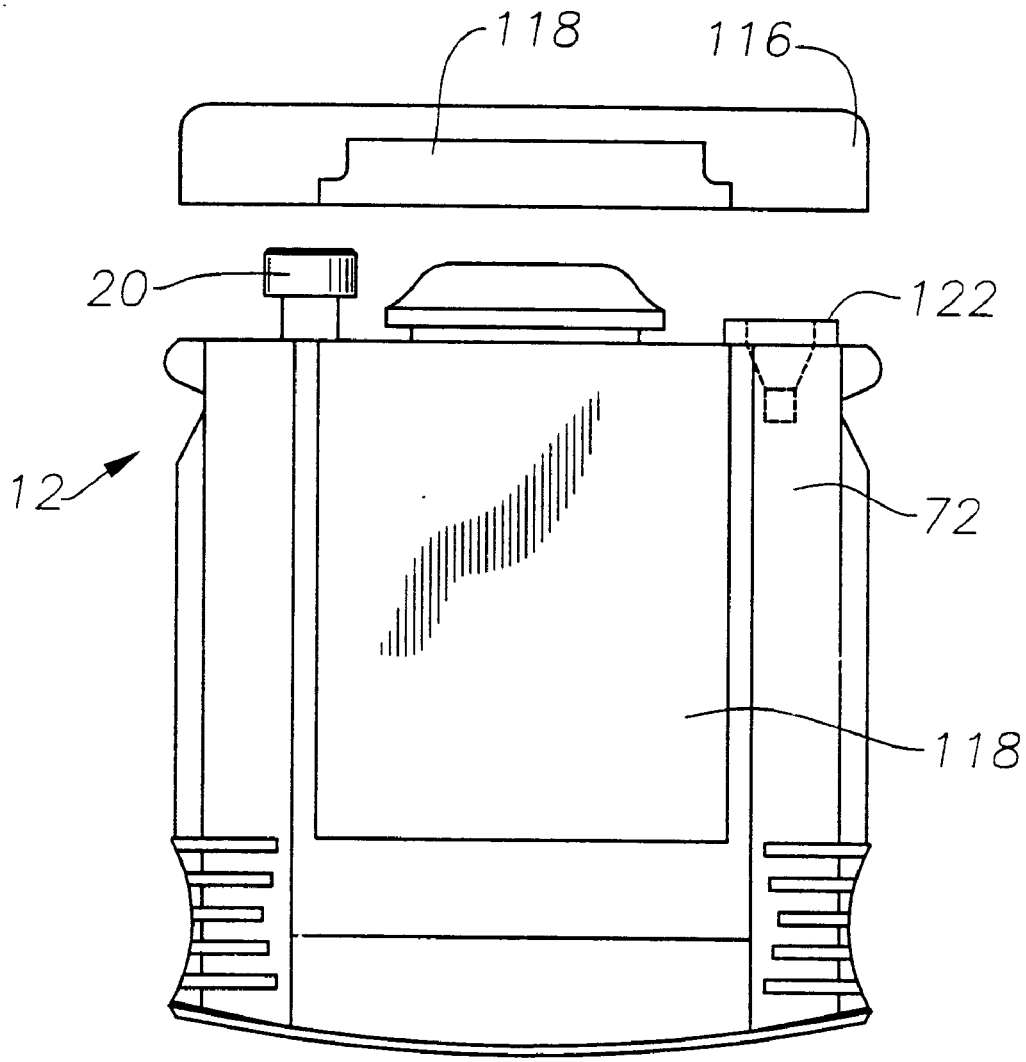
FIG. 11 is a side view of the ink container of FIG. 1 with a cap portion removed.
Figure 12:
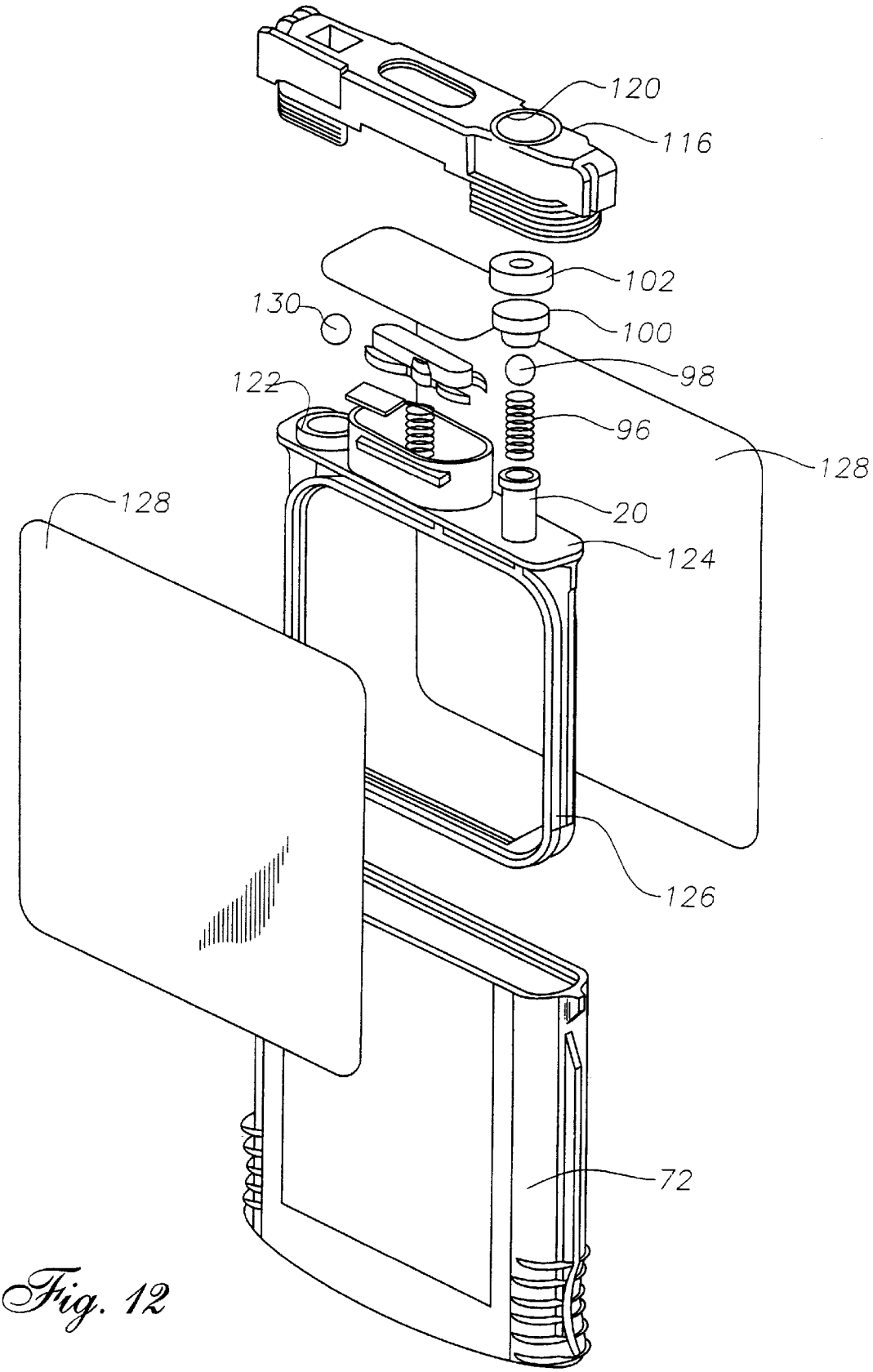
FIG. 12 is an exploded isometric view of the ink container of FIG. 1.

Referring to FIGS. 11 and 12, a cap 116 is secured to shell 72 during assembly by labels 118 (FIGS. 5 and 11) on each side. In the preferred embodiment, each label 118 is a thin, multilaminate rectangular film with an adhesive coating on one side. One label 118 is located on each side of ink container 12 and partially overlaps housing 72 and cap 116 as shown in FIG. 11. Labels 118 have a structural function of securing cap 116 to housing 72. Labels 118 offer at least some and perhaps all of the structure support or attachment of cap 116 to housing 72. There may be a snap fit or other joining method that augments labels 118. As shown in FIG. 12, cap 116 has an opening 120 that aligns with fluid outlet 20 for allowing access thereto.

Figure 14:
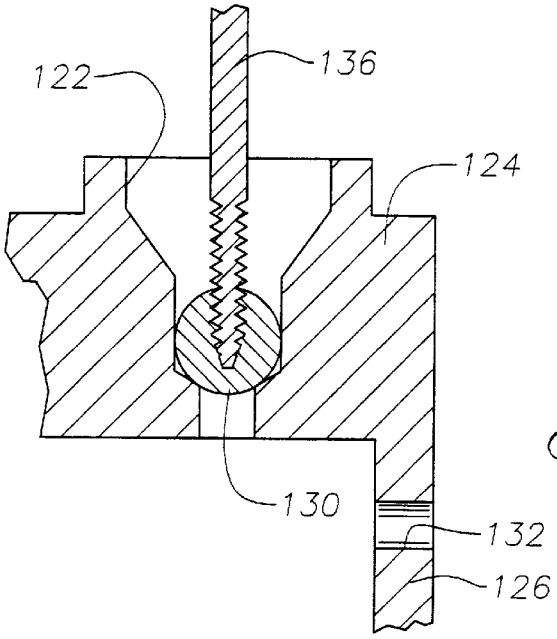
FIG. 14 is an enlarged, partial sectional side view of the chassis of FIG. 13 taken along the line 14—14 of FIG. 13.

As shown in FIGS. 11 and 12, the removal of cap 116 exposes several components of ink container 12. Along with fluid outlet 20 and part of reservoir 22 (described above), a fill port 122 is exposed. Fill port 122 extends through a chassis 124 (FIG. 14) on a bottom end. Chassis 124 is an open, square-shaped, frame-like structure that defines a perimeter of reservoir 22 with a top, a bottom, two sides and two vertical edges 126. Both sides of chassis 124 are covered and sealed with a flexible sheet or film 128. When ink container 12 is assembled, chassis 124 is located inside housing 72. Fill port 122 is in fluid communication with reservoir 22 before it is permanently sealed. Fill port 122 is used during the assembly of ink container 12 to fill reservoir 22 for the first time. After reservoir 22 is filled during original assembly, fill port 122 is permanently sealed by inserting a plug, preferably a ball 130 (FIGS. 12 and 14) into fill port 122. Ball 130 lodges or wedges within fill port 122.

The original assembly of ink supply 12 includes the following steps, although they are not necessarily limited to the order given. Only the assembly details that pertain to the invention are included:

1. Provide chassis 124 including fluid outlet 20 and perimetrical sealing surfaces on edges 126;
2. Attach and seal film sheets 128 to perimetrical sealing surfaces to form reservoir 22;
3. Assemble spring 96, sealing ball 98, crimp cap 102, septum 100 to boss 90 to form fluid outlet 20;
4. Fill ink container 12 through fill port 122;
5. Seal fill port 122 with sealing ball 130;
6. Enclose upper part of chassis 124 with shell portion 72;
7. Substantially enclose lower portion of chassis 124 with cap 116; and
8. Secure cap 116 to shell 72 with a label 118 on each side.

We now turn to techniques for refilling ink container 12 with ink. In one method, the structural attachment provided by the labels 118 between the cap 116 and the housing 72 is disabled or released. This can be done by a number of methods, including severing the labels 118 along the interface between housing 72 and cap 116, as indicated in FIG. 11. Alternatively, the labels 118 can be at least partially peeled from either cap 116 or housing 72. The cap 116 is then removed from housing 72 to allow fill port 122 to be unsealed. Fill port 122 is unsealed by displacing ball 130 or forming a fluid path in ball 130. One way to do this is to push ball 130 into reservoir 22, although alternative methods of unsealing fill port 122 are described below. After fill port 122 is unsealed, reservoir 22 may be refilled with ink. After reservoir 22 is refilled with ink, fill port 122 is resealed. This can be done by reinserting a new or re-used ball 130, or by resealing the fill port 122 with an alternative sealing means such as a resilient plug, a threaded member, or an adhesive. After resealing fill port 122, the cap 116 is reinstalled on housing 72. In a preferred embodiment, new or re-used labels are used to secure cap 116 to housing 72 with a preferred placement of the labels as illustrated with respect to FIG. 5.

A second method for refilling ink container 12 does not require filling through fill port 122. The structural support provided by labels 118 is disabled as described above so that cap 116 may be removed from housing 72. Next, chassis 124 is removed from housing 72. A small hole 132 (FIG. 13) may be formed by a method such as drilling through one of sides 126 of chassis 124 into reservoir 22 to establish a fluid path into reservoir 22. Reservoir 22 is refilled with ink through hole 132. Hole 132 is then sealed with a sealing means, such as a resilent plug or an adhesive. Alternatively, hole 132 may also be tapped so that a threaded plug may be inserted into hole 132. Chassis 124 is reinstalled in housing 22 and cap 116 is reassembled to housing 72. In a preferred embodiment, structural support between cap 116 and housing 72 is provided by applying at least one label that bridges housing 72 to cap 116.

Figure 13:
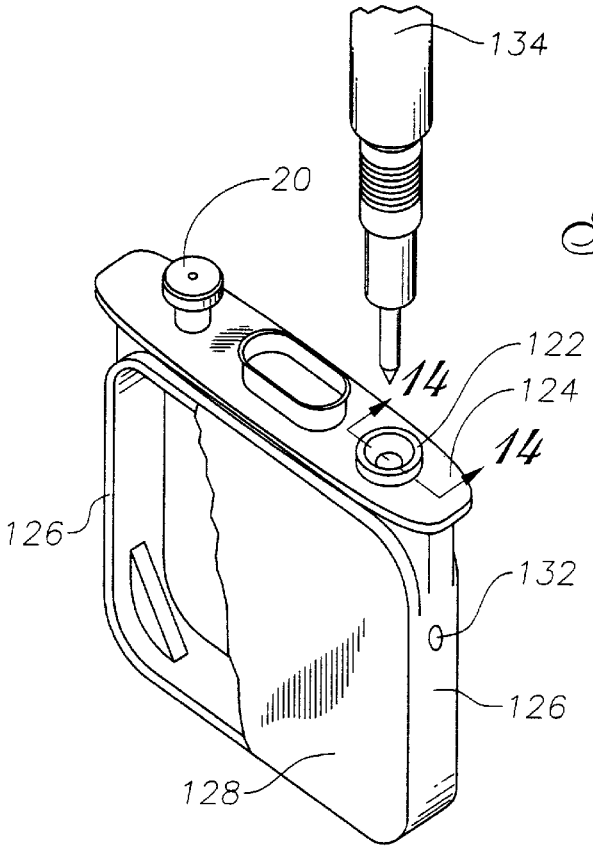
FIG. 13 is isometric view of a chassis located within the ink container of FIG. 1.

Alternative methods for removing the sealing ball 130 are illustrated in FIG. 13. A hot probe 134 is stabbed through ball 130 so that a hole is created through fill port 122 to establish a fluid path to reservoir 22. Alternatively, ball 130 may be unseated with a threaded tap 136 (FIG. 14) by screwing tap 136 into ball 130 and then pulling ball 130 out of fill port 122. For this third method, hole 132 is not drilled. Reservoir 22 is refilled with ink through the fill port 122, which is then resealed as described above. Afterwards, cap 116 is reassembled with the original or new labels 118 so that its opening 120 aligns with fluid outlet 20.

In addition to refilling with ink, refurbishment also must be performed in regard to memory device 26 (FIG. 7) so that the benefits previously provided by memory device 26 still exist. The original memory device 26, which is located in cavity 80 (FIG. 7), provides a first source of signals indicative of an at least partially depleted ink level state of ink container 12. As explained above, the volume of ink left in reservoir 22 is at least partially stored in the write once section of memory 26 as coarse ink level data. Consequently, even though reservoir 22 is refilled, memory device 26 would not be able to provide accurate data. The user would not be provided with a proper low ink or out of ink condition signal and would not derive the other benefits of memory device 26.

To refurbish memory device 26, the pre-existing data in memory device 26 is prevented from further communication with printing system 11 when cartridge 12 is installed again. In one technique, all of the data in memory device 26 is erased. This can be accomplished by exposing the memory device 26 to an energy source such as an x-ray, electric field, or high temperature. This energy source, is sufficient, resets the data in memory device 26. The reservoir of ink container 12 is then refilled. Then memory device 26 can be reprogrammed to reflect parameters of the refilled ink container 12. When installed in the printing system 10 the printing system operates with the ink container 12 in a manner similar to the initial ink container.

In another refurbishment method, memory device 26 is disabled and replaced with a new memory device 26 or with an emulator. The new memory device 26 may be substantially identical to the original memory device 26. An emulator is an electronic circuit that is functionally equivalent to memory device 26 in providing information to printing system 10 (FIG. 1) though structurally this device may be very different. An emulator would likely have a portion that functions as a memory and would likely provide information regarding the volume of reservoir 22, the type of ink, color, etc. Optionally, unlike original memory device 26, the emulator may be reset in a different manner whenever a new ink supply is provided. Further, the emulator may be configured to provide information to printing system 10 which enables it to operate regardless of the actual condition of the ink in ink reservoir 22.

The new source of signals includes the data required for proper operation of printing system 10. The new source of signals must be able to communicate with printing system 10 over a single wire input/output in serial fashion. This data will be used by printing system 10 to provide an indication of the volume of ink available.

In one technique for refurbishing ink container 12, the first memory device 26 will be removed from cavity 80 of housing 72 (FIG. 7). The substrate 78, along with memory device 26 and contacts 24, may be pried off or otherwise removed as a unit from cavity 80. A new substrate 78, having a new memory device 26 or emulator and contacts 24, may be adhesively bonded to a sidewall of cavity 80 in the same place that held the original substrate 78, memory device 26 and contacts 24.

Alternately, a substrate 78 containing only a new set of contacts 24 may be mounted in cavity 80. The new memory device 26 or emulator may be mounted at another place on housing 72 of refurbished cartridge 12 and connected to the new set of contacts 24 by leads.

Another refurbishment method allows the original substrate 78, memory device 26 and contacts 24 to remain in place. A new substrate 78, along with a new memory device 26 and contacts 24, will be bonded on top of the original memory device 26 and contacts 24. As the material of the substrate 78 is an electrical insulator, it will insulate the new contacts 24 and traces 81 (FIG. 10) from the original contacts 24 and traces 81. The original contacts 24 will not be able to electrically engage printing system contacts 30 (FIG. 8) because they will be covered and insulated from engagement by the new substrate 78. This technique may be performed several times before electrical connection with printing system 10 becomes difficult due to space constraints. Cavity 80 becomes effectively smaller each time a new substrate 78, along with new contacts 24 and a new memory device 26, are installed on top of an earlier set.

In another refurbishment process, a usable portion of the original contacts 24 remains in place and is electrically separated from the original memory device 26. In this method, preferably a cut is made through the substrate 78 transversely across one or more contacts 24 with a sharp object such as knife. The cut divides the substrate 78 into retained and disposable portions, the retained portion of which contains a significant portion of contacts 24. The substrate 78 disposable portion contains memory device 26, along with traces 81 and a small adjacent part of contacts 24. This cut severs electrical continuity between the four terminals of memory device 26 with the part of contacts 24 contained on the substrate 78 retained portion. Although, the size of contacts 24 on substrate 78 retained portion would be smaller than the original contacts 24, they are of adequate size to mate with printing system contacts 30 (FIG. 10).

Normally, one would then remove from cavity 80 the disposable portion of substrate 78, along with the first memory device 26, traces 81, and the part of contacts 24 contained thereon. A new memory device 26 may then be mounted adjacent to or on the original contacts 24 contained on the retained substrate portion, with its terminals connected to them. Optionally, the new memory device 26 could be mounted elsewhere on housing 72 other than cavity 80 (FIG. 7) or even remotely from printing system 10 and connected to original contacts 24 by leads. Alternately, the contacts 24 on the retained portion of substrate 78 may be connected to leads that are attached to a remotely located emulator or memory 26.

In another method, a new cap 116 having a new plurality of contacts 24 may be installed in place of the original cap 116. The new plurality of contacts 24 are electrically coupled to a new memory device 26 or an emulator that functions in a similar manner as the original memory device 26. When this new cap 116 is properly aligned and assembled to ink container 12, with the orifice 120 aligned with fluid outlet 20, the second plurality of contacts 24 are configured to properly engage the contacts 30 (FIG. 10) when ink container 12 is releasably installed into receiving station 14.

The invention has a number of advantages. These alternate methods of refurbishing allow ink containers which are otherwise single use to be reused multiple times while maintaining the functional benefits of the original ink containers.

Additional advantages are evident upon considering the preferred embodiment of the invention, which includes utilization of labels 118, disassembly and reassembly of a cap and shell structure, and filling through a port 122 separate from the fluid outlet 20. In particular, the use of labels 118 to secure the cap and housing structure allows a non-destructive and reversible way of detaching the cap 116 from the housing 72 and securing the cap 116 to the housing 72. The use of a cap 116 for refurbishment allows utilization of the original cap 116 or providing a new cap 116 with a new set of contacts 24. Refilling through an opening that is separate from the fluid outlet 20 of the ink container 12 allows refilling the container 12 without possible damage to the fluid outlet 20. Additionally, in a one embodiment of ink container 12, a valve is interposed between reservoir 22 and fluid outlet 20 that limits the flow of ink from fluid outlet 20 to reservoir 22, making refilling through an opening that is separate from fluid outlet 20 preferable.

What is claimed is:

1. A method for refilling a printing system ink container that previously exhibited a filled ink condition and now exhibits an at least partially depleted ink condition, the ink container having a housing, an ink reservoir located within the housing and having a fluid outlet and a fill port, the fill port being sealed with an internal plug, a cap having a cavity with two opposing side walls mounted to the housing and enclosing the fill port, and a memory device having contacts mounted to one of the opposing side walls in the cavity for communicating information concerning characteristics of the ink in the ink reservoir and the at least partially depleted ink condition to the printing system, the method comprising the steps of:

(a) creating an opening in the fill port;

(b) refilling the ink reservoir through the fill port;

(c) resealing the opening in the fill port;

(d) refurbishing the memory device indicating the at least partially depleted ink condition, such that the memory device provides enabling information to the printing system indicating that the ink reservoir of the ink container has an increased amount of ink so as to enable the printing system to operate.

2. The method of claim 1 wherein the fill port has a passage which contains the internal plug and step (a) comprises inserting a tool into the passage, threading the tool into the plug and pulling the plug from the passage.

3. The method of claim 1 wherein the step (a) comprises creating a hole in the sealed fill port with hot probe.

4. The method of claim 1 wherein step (d) comprises:

erasing data in the memory device such that the data no longer indicates the at least partially depleted ink condition of the ink reservoir of the ink container and the memory device no longer provides enabling information to the printing system; and reprogramming the data of the memory device such that the data now indicates that the ink reservoir of the ink container has an increased amount of ink and the memory device can now provide enabling information to the printing system.

5. The method of claim 1 wherein the memory device is bonded to one of the opposing side walls in the cavity; and wherein step (d) comprises:

removing the memory device from the cavity by prying the memory device from the one of the opposing side walls; and securing a plurality of contacts and a second memory device to said one of the opposing walls, the plurality of contacts being electrically coupled to the second memory device, the second memory device indicating that the ink reservoir of the ink container has an increased amount of ink so as to provide enabling information to the printing system.

6. The method of claim 1, wherein step (d) comprises:

providing a plurality of second contacts bonded to one of the opposing side walls in the cavity, the second contacts supplanting the contacts of the memory device; and providing a signal source that is electrically coupled to the plurality of second contacts, the signal source supplanting the memory device and producing signals that are indicative of an increased amount of ink in the ink reservoir.

7. The method of claim 1 wherein step (d) comprises:

severing the memory device from communication with the contacts; and connecting an electrical device to the contacts of the memory device for supplanting the memory device and providing enabling information to the printing system indicative of an increased amount of ink in the ink reservoir.

8. The method of claim 1 wherein step (d) comprises placing a second memory device on top of the memory device to supplant the memory device, the second memory device providing enabling information to the printing system indicative of an increased amount of ink in the ink reservoir.

9. The method of claim 10 wherein the memory device and the printing system exchange data in serial fashion over a single data line relative to a reference line, and wherein step (d) comprises:

disabling the memory device such that the memory device may no longer exchange data with the printing system indicative of the at least partially depleted ink condition of the ink reservoir; and providing an electrical device to supplant the memory device which, when connected to the printing system, provides data in a serial fashion on the single data line of the printing system relative to the reference line indicative of an increased amount of ink in the ink reservoir.

10. The method of claim 1 wherein at least one adhesive film provides structural support between the cap and the housing, and wherein prior to step (a), the method includes the step of:

disabling the structural support provided by the at least one adhesive film and removing the cap from the housing to expose the fill port.

11. The method of claim 10, wherein the structural support provided by the at least one adhesive film is disabled by severing the adhesive film.

12. The method of claim 10 wherein after step (d), the method includes the step of:

reassembling the cap to the housing.

13. A method for refilling a previously used ink container exhibiting an at least partially depleted ink condition, the ink container being releasably insertable into an ink jet printing system, the ink container including a reservoir portion surrounded by an outer housing, the ink container including a first cap portion that is attached to the outer housing, the first cap portion including a first information storage device mounted thereon that provides information to the printing system indicative of an at least partially depleted volume of deliverable ink in the reservoir, the at least partially depleted volume of ink is less than an initial volume of ink present in the ink reservoir, the method comprising the steps of:

removing the first cap portion from the housing;

disabling the first information storage device so that it no longer provides data to the printing system indicating the at least partially depleted ink condition of the ink reservoir of the ink container;

creating an opening in the reservoir portion;

refilling the ink reservoir through the opening;

resealing the opening in the reservoir portion; and attaching a second cap portion to the housing, the second cap portion including a second information storage device and a plurality of contacts that provide electrical coupling between the printing system and the second information storage device to allow the second information storage device to provide data to the printing system indicative of an increased volume of ink in the ink container when the ink container is releasably inserted into the printing system.

14. The method of claim 13, wherein the first information storage device is disabled by erasing the data indicating the at least partially depleted ink condition, and wherein the second information storage device is the first information storage device after being reprogrammed to indicate an increased volume of ink in the ink reservoir.

15. The method of claim 13, wherein the second information storage device is a replacement electrical circuit for the first information storage device.

16. The method of claim 13, wherein the second cap portion and the first cap portion are the same.

17. The method of claim 13, wherein the second cap portion includes a cavity and a leading edge defined relative to a direction of insertion of the ink container into the printing system, and wherein the cavity is accessible from the leading edge of the second cap portion and the plurality of contacts are disposed within the cavity adjacent to the leading edge.

* * * * *